US009316979B2

(12) United States Patent
Nozawa et al.

(10) Patent No.: US 9,316,979 B2
(45) Date of Patent: Apr. 19, 2016

(54) FIXING DEVICE AND IMAGE FORMING APPARATUS

(71) Applicants: Kenji Nozawa, Kanagawa (JP); Masami Okamoto, Kanagawa (JP); Yoshikuni Sasaki, Kanagawa (JP); Yuuki Kikushima, Kanagawa (JP); Fumihiro Hirose, Kanagawa (JP); Keisuke Kubota, Kanagawa (JP); Shuutaroh Yuasa, Kanagawa (JP); Kaori Hemmi, Kanagawa (JP)

(72) Inventors: Kenji Nozawa, Kanagawa (JP); Masami Okamoto, Kanagawa (JP); Yoshikuni Sasaki, Kanagawa (JP); Yuuki Kikushima, Kanagawa (JP); Fumihiro Hirose, Kanagawa (JP); Keisuke Kubota, Kanagawa (JP); Shuutaroh Yuasa, Kanagawa (JP); Kaori Hemmi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/632,523

(22) Filed: Feb. 26, 2015

(65) Prior Publication Data

US 2015/0261154 A1 Sep. 17, 2015

(30) Foreign Application Priority Data

Mar. 11, 2014 (JP) ..... 2014-047763

(51) Int. Cl.
*G03G 15/20* (2006.01)

(52) U.S. Cl.
CPC ..... *G03G 15/2085* (2013.01); *G03G 15/2053* (2013.01); *G03G 15/2075* (2013.01); *G03G 2215/2032* (2013.01)

(58) Field of Classification Search
CPC ..... G03G 15/20
USPC ..... 399/323
See application file for complete search history.

(56) References Cited

U.S. PATENT DOCUMENTS

| | | | | |
|---|---|---|---|---|
| 5,778,294 | A * | 7/1998 | Hiraoka et al. | 399/329 |
| 7,801,473 | B2 * | 9/2010 | Ando | 399/323 |
| 7,970,330 | B2 * | 6/2011 | Condello et al. | 399/329 |
| 2005/0185996 | A1 * | 8/2005 | Oishi et al. | 399/329 |
| 2006/0147231 | A1 * | 7/2006 | Aruga et al. | 399/329 |
| 2006/0245800 | A1 * | 11/2006 | Fujino | 399/329 |
| 2007/0048035 | A1 * | 3/2007 | Baba et al. | 399/323 |
| 2008/0124146 | A1 * | 5/2008 | Bae et al. | 399/329 |
| 2010/0178085 | A1 * | 7/2010 | Keenan et al. | 399/323 |
| 2011/0064492 | A1 * | 3/2011 | Ichikawa et al. | 399/329 |
| 2011/0081173 | A1 * | 4/2011 | Watanabe et al. | 399/323 |

(Continued)

FOREIGN PATENT DOCUMENTS

| | | | | |
|---|---|---|---|---|
| JP | 2004-264398 | | 9/2004 | |
| JP | 2008-134356 | * | 6/2008 | G03G 15/20 |

(Continued)

*Primary Examiner* — Clayton E Laballe
*Assistant Examiner* — Kevin Butler
(74) *Attorney, Agent, or Firm* — Harness, Dickey & Pierce, P.L.C.

(57) ABSTRACT

A fixing device includes a first roller contacting a fixing belt to generate a rotation friction force therebetween to rotate the fixing belt and a second roller contacting the fixing belt to exert a first inhibition force to the fixing belt in a direction opposite a direction of rotation of the fixing belt. A separation aid is disposed downstream from a fixing nip formed between the fixing belt and a pressure rotator in the direction of rotation of the fixing belt to decrease a curvature of the fixing belt and exert a second inhibition force to the fixing belt in the direction opposite the direction of rotation of the fixing belt. The second inhibition force is added to the first inhibition force to obtain a combined inhibition force that is smaller than the rotation friction force between the fixing belt and the first roller.

19 Claims, 4 Drawing Sheets

(56) References Cited

U.S. PATENT DOCUMENTS

| | | | | |
|---|---|---|---|---|
| 2011/0135357 | A1* | 6/2011 | Okabayashi et al. | 399/329 |
| 2012/0177388 | A1 | 7/2012 | Imada et al. | |

FOREIGN PATENT DOCUMENTS

| | | |
|---|---|---|
| JP | 2012-145710 | 8/2012 |
| JP | 2013-186352 | 9/2013 |

* cited by examiner

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2014-047763, filed on Mar. 11, 2014, in the Japanese Patent Office, the entire disclosure of which is hereby incorporated by reference herein.

BACKGROUND

1. Technical Field

Example embodiments generally relate to a fixing device and an image forming apparatus, and more particularly, to a fixing device for fixing a toner image on a recording medium and an image forming apparatus incorporating the fixing device.

2. Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing roller, a heating roller, an endless fixing belt stretched taut across the fixing roller and the heating roller, and a pressure roller pressed against the fixing roller via the fixing belt to form a fixing nip between the fixing belt and the pressure roller. The fixing belt is rotated by the fixing roller and heated by a heater. As a recording medium bearing a toner image is conveyed through the fixing nip, the fixing belt and the pressure roller apply heat and pressure to the recording medium, melting and fixing the toner image on the recording medium.

SUMMARY

At least one embodiment provides a novel fixing device that includes an endless fixing belt rotatable in a predetermined direction of rotation, a first roller contacting the fixing belt and including a surface elastic layer to generate a rotation friction force between the fixing belt and the first roller to rotate the fixing belt, and a second roller contacting the fixing belt to exert a first inhibition force to the fixing belt in a direction opposite the direction of rotation of the fixing belt. The fixing belt is stretched taut across the first roller and the second roller. A pressure rotator is pressed against the first roller via the fixing belt to form a fixing nip between the fixing belt and the pressure rotator, through which a recording medium is conveyed. A separation aid is disposed downstream from the fixing nip in the direction of rotation of the fixing belt to decrease a curvature of the fixing belt and exert a second inhibition force to the fixing belt in the direction opposite the direction of rotation of the fixing belt. The second inhibition force is added to the first inhibition force to obtain a combined inhibition force that is smaller than the rotation friction force between the fixing belt and the first roller.

At least one embodiment provides a novel image forming apparatus that includes an image forming device to form a toner image and a fixing device, disposed downstream from the image forming device in a recording medium conveyance direction, to fix the toner image on a recording medium. The fixing device includes an endless fixing belt rotatable in a predetermined direction of rotation, a first roller contacting the fixing belt and including a surface elastic layer to generate a rotation friction force between the fixing belt and the first roller to rotate the fixing belt, and a second roller contacting the fixing belt to exert a first inhibition force to the fixing belt in a direction opposite the direction of rotation of the fixing belt. The fixing belt is stretched taut across the first roller and the second roller. A pressure rotator is pressed against the first roller via the fixing belt to form a fixing nip between the fixing belt and the pressure rotator, through which the recording medium is conveyed. A separation aid is disposed downstream from the fixing nip in the direction of rotation of the fixing belt to decrease a curvature of the fixing belt and exert a second inhibition force to the fixing belt in the direction opposite the direction of rotation of the fixing belt. The second inhibition force is added to the first inhibition force to obtain a combined inhibition force that is smaller than the rotation friction force between the fixing belt and the first roller.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
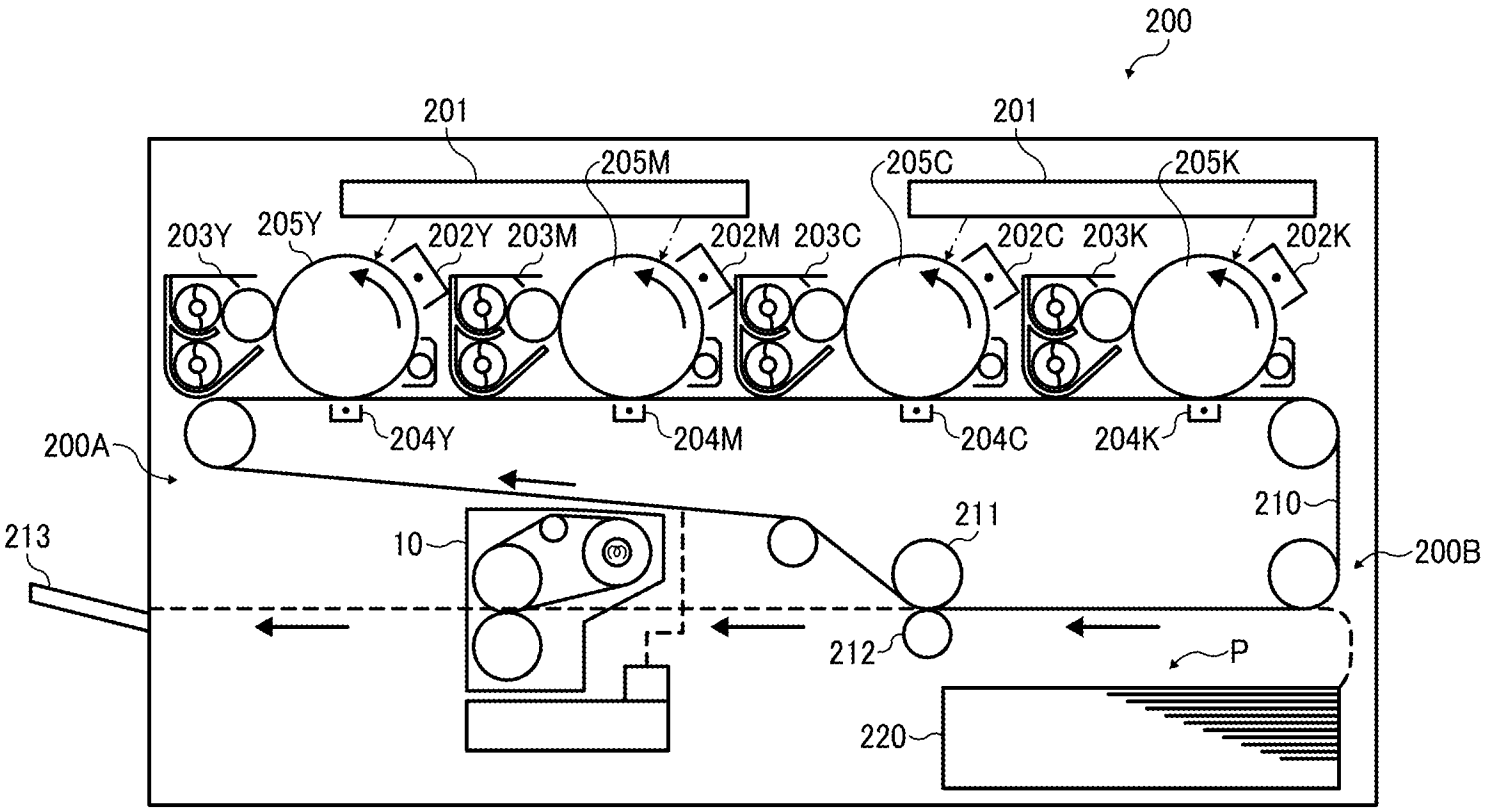
FIG. 1 is a schematic vertical sectional view of an image forming apparatus according to an example embodiment of the present disclosure.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors used herein are interpreted accordingly.

Although the terms first, second, and the like may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present disclosure.

The terminology used herein is for the purpose of describing particular embodiments only and is not intended to be limiting of the present disclosure. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 200 according to an example embodiment is explained.

FIG. 1 is a schematic vertical sectional view of the image forming apparatus 200. The image forming apparatus 200 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 200 is a color copier that forms color and monochrome toner images on recording media by electrophotography. Alternatively, the image forming apparatus 200 may be a monochrome copier that forms monochrome toner images.

A description is provided of a construction of the image forming apparatus 200.

As shown in FIG. 1, the image forming apparatus 200 is a high speed, tandem color copier.

The image forming apparatus 200 includes an image forming device 200A situated in a center portion of the image forming apparatus 200, a sheet feeder 200B situated below the image forming device 200A, and an image reader situated above the image forming device 200A.

A detailed description is now given of a construction of the image forming device 200A.

The image forming device 200A includes a fixing device 10 and a transfer belt 210 having a horizontally extending, transfer face.

An upper face of the transfer belt 210 is disposed opposite components that form toner images in complementary colors created based on separation colors. For example, photoconductors 205Y, 205M, 205C, and 205K, serving as image bearers that bear yellow, magenta, cyan, and black toner images in the complementary colors, respectively, are aligned along the transfer face of the transfer belt 210.

Each of the photoconductors 205Y, 205M, 205C, and 205K is a drum rotatable counterclockwise in FIG. 1 in an identical direction. The photoconductors 205Y, 205M, 205C, and 205K are surrounded by an optical writing device 201, chargers 202Y, 202M, 202C, and 202K, developing devices 203Y, 203M, 203C, and 203K, primary transfer devices 204Y, 204M, 204C, and 204K, and cleaners, respectively, which perform image formation processes as the photoconductors 205Y, 205M, 205C, and 205K rotate.

The developing devices 203Y, 203M, 203C, and 203K contain yellow, magenta, cyan, and black toners, respectively. The transfer belt 210 looped over a driving roller and a plurality of driven rollers is disposed opposite the photoconductors 205Y, 205M, 205C, and 205K and rotatable clockwise in FIG. 1. A roller 211, that is, one of the plurality of driven rollers, is disposed opposite a transfer roller 212 via the transfer belt 210. A conveyance path extends horizontally from the transfer roller 212 to the fixing device 10 to convey a sheet P.

A detailed description is now given of a construction of the sheet feeder 200B.

The sheet feeder 200B includes a paper tray 220 that loads a plurality of sheets P serving as recording media and a feed device that separates an uppermost sheet P from other sheets P loaded in the paper tray 220 and conveys the sheet P to the transfer roller 212.

A description is provided of a print job performed by the image forming apparatus 200 having the construction described above.

The charger 202Y uniformly changes an outer circumferential surface of the photoconductor 205Y. The optical writing device 201 forms an electrostatic latent image on the photoconductor 205Y according to image data sent from the image reader. The developing device 203Y containing yellow toner visualizes the electrostatic latent image into a yellow toner image. The primary transfer device 204Y applied with a given bias primarily transfers the yellow toner image onto the transfer belt 210.

Similarly, magenta, cyan, and black toner images are formed on the photoconductors 205M, 205C, and 205K, respectively, and primarily transferred onto the transfer belt 210 successively by an electrostatic force such that the yellow, magenta, cyan, and black toner images are superimposed on a same position on the transfer belt 210, thus forming a color toner image on the transfer belt 210.

The roller 211 and the transfer roller 212 secondarily transfer the color toner image formed on the transfer belt 210 onto the sheet P conveyed from the paper tray 220. The sheet P bearing the color toner image is conveyed further to the fixing device 10 where the color toner image is fixed on the sheet P as the sheet P passes through a fixing nip formed between a fixing belt and a pressure roller. The sheet P ejected from the fixing nip is conveyed onto a stacker 213 through an output path.

A description is provided of a construction of the fixing device 10 according to a first example embodiment.

Figure 2:
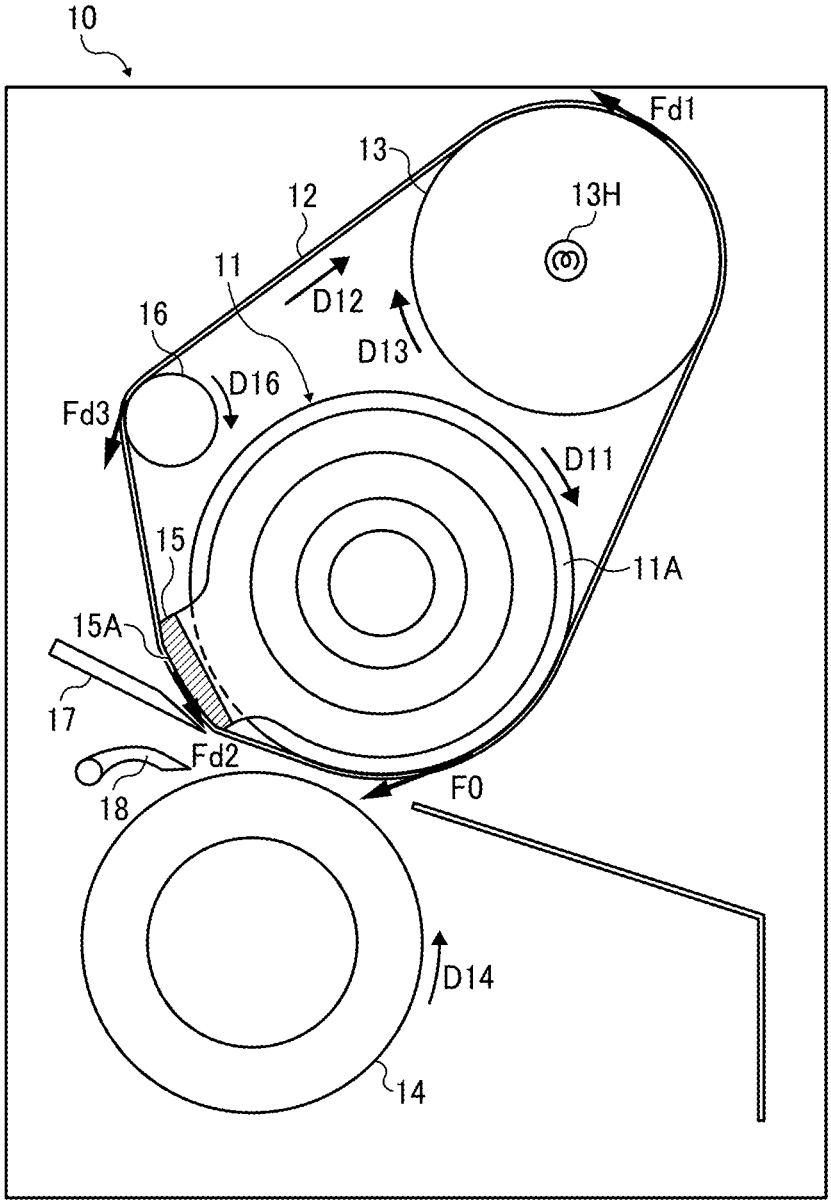
FIG. 2 is a schematic vertical sectional view of a fixing device according to a first example embodiment incorporated in the image forming apparatus shown in FIG. 1.

FIG. 2 is a schematic vertical sectional view of the fixing device 10. As shown in FIG. 2, the fixing device 10 (a fuser or a fusing unit) includes a fixing roller 11 serving as a first roller having a surface elastic layer 11A constituting an outer circumferential surface of the fixing roller 11; a heating roller 13 accommodating a heater 13H; an endless fixing belt 12 stretched taut across the fixing roller 11 and the heating roller 13 and heated by the heater 13H through the heating roller 13; a pressure roller 14 serving as a pressurization member or a pressure rotator disposed opposite the fixing roller 11 via the fixing belt 12; a separation aid 15 disposed inside a loop formed by the fixing belt 12; and a tension roller 16 that exerts tension to the fixing belt 12.

Figure 3:
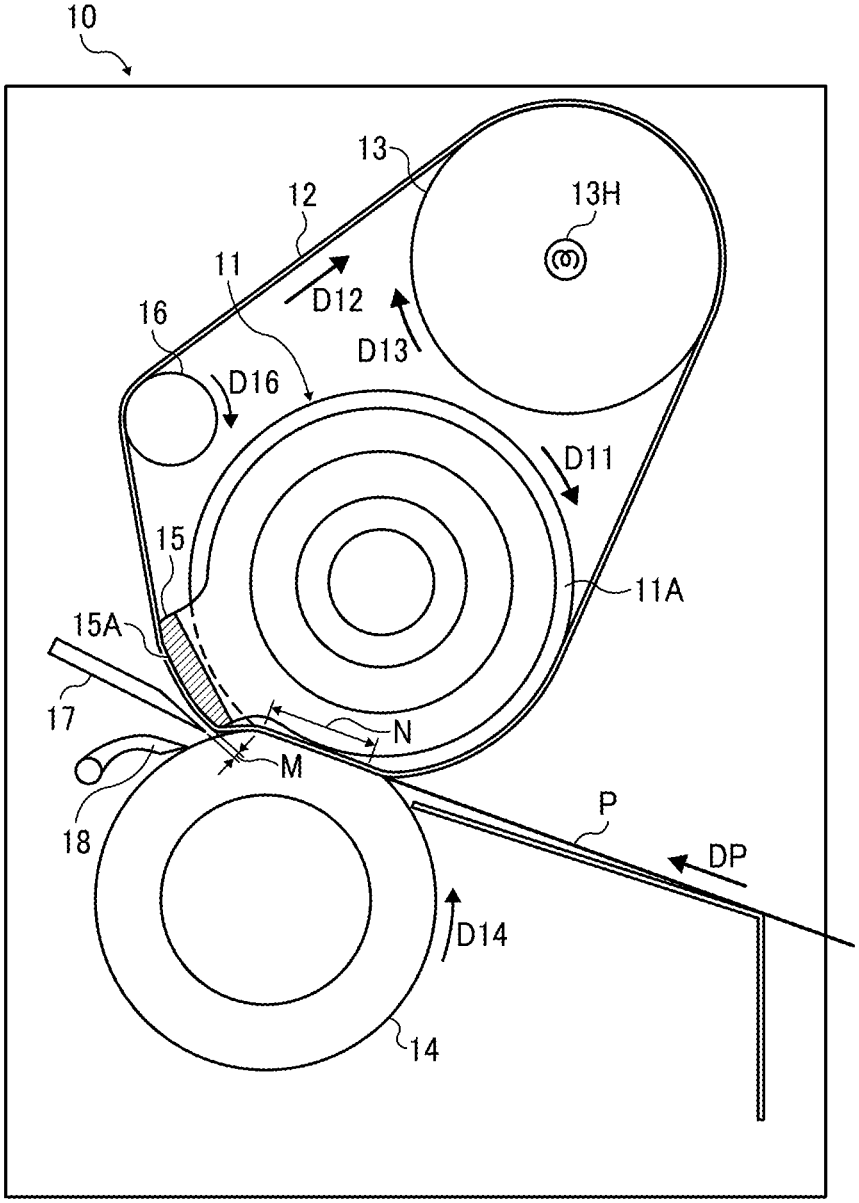
FIG. 3 is a schematic vertical sectional view of the fixing device shown in FIG. 2 illustrating a pressure roller pressed against a fixing roller.

FIG. 3 is a schematic vertical sectional view of the fixing device 10 illustrating the pressure roller 14 pressed against the fixing roller 11. As shown in FIG. 3, the fixing device 10 further includes a separator 17 and a separation claw 18 disposed downstream from a fixing nip N formed between the fixing belt 12 and the pressure roller 14 in a sheet conveyance direction DP. The separator 17 separates the sheet P from the fixing belt 12. The separation claw 18 prevents the sheet P from being wound around the pressure roller 14.

A detailed description is now given of a configuration of the fixing roller 11.

The fixing roller 11 is constructed of a cored bar made of metal and the elastic layer 11A coating the cored bar and made of silicone rubber. Alternatively, the elastic layer 11A may be made of silicone rubber foam to reduce heat absorbed to the fixing belt 12 and thereby shorten a warm-up time to warm up the fixing belt 12 to a target temperature. As shown in FIG. 3, as the pressure roller 14 is pressed against the fixing roller 11 via the fixing belt 12, the elastic layer 11A of the fixing roller 11 is elastically deformed to decrease an outer diameter of the fixing roller 11. A driver drives and rotates the fixing roller 11 clockwise in FIG. 3 in a rotation direction D11.

A detailed description is now given of a configuration of the fixing belt 12.

The fixing belt 12 is a double layered endless belt constructed of a base layer made of nickel, stainless steel, polyimide, or the like and an elastic layer made of silicone rubber or the like. The fixing belt 12 is stretched taut across the fixing roller 11 and the heating roller 13 with a given tension and rotatable in accordance with rotation of the fixing roller 11. Thus, the fixing belt 12 rotates forward clockwise in FIG. 3 in a rotation direction D12.

A detailed description is now given of a configuration of the heating roller 13.

The heating roller 13 is a hollow roller made of aluminum or iron and accommodating the heater 13H (e.g., a halogen heater). Alternatively, the heater 13H may be an induction heater (IH). The heating roller 13 is rotatable clockwise in FIG. 3 in a rotation direction D13. The heater 13H heats the heating roller 13 to a given temperature (e.g., a fixing temperature appropriate to fix a toner image on a sheet P) that is detected by a thermistor. The heating roller 13 in turn heats the fixing belt 12.

A detailed description is now given of a configuration of the pressure roller 14.

The pressure roller 14 is a tube constructed of a cored bar made of aluminum, iron, or the like and an elastic layer coating the cored bar and made of silicone rubber or the like. A driver drives and rotates the pressure roller 14 counterclockwise in FIG. 3 in a rotation direction D14. A pressurization assembly separably presses the pressure roller 14 against the fixing roller 11 via the fixing belt 12. For example, the pressurization assembly presses the pressure roller 14 against the fixing roller 11 via the fixing belt 12 and releases pressure between the pressure roller 14 and the fixing roller 11. While the fixing device 10 is actuated, the pressure roller 14 is pressed against the fixing roller 11 via the fixing belt 12 with given pressure to form the fixing nip N between the pressure roller 14 and the fixing belt 12 as shown in FIG. 3. Conversely, while the fixing device 10 is in a standby mode in which the fixing device 10 waits for a print job, the pressure roller 14 is isolated from the fixing belt 12 as shown in FIG. 2.

According to this example embodiment, the pressure roller 14 is used as a pressurization member or a pressure rotator. Alternatively, an endless belt looped over a plurality of rollers (e.g., two rollers) may be used as a pressurization member or a pressure rotator.

A detailed description is now given of a configuration of the separation aid 15.

As shown in FIG. 3, the separation aid 15, disposed downstream from the fixing nip N in the rotation direction D12 of the fixing belt 12 or the sheet conveyance direction DP, projects from the outer circumferential surface of the fixing roller 11 radially. The separation aid 15 includes a contact face 15A that contacts an inner circumferential surface of the fixing belt 12. The contact face 15A is coated with fluoroplastic to produce a smooth surface having a decreased kinetic friction coefficient. The separation aid 15 contacting the fixing belt 12 decreases a radius of curvature of the fixing belt 12 at a position downstream from the fixing nip N in the sheet conveyance direction DP.

A detailed description is now given of a configuration of the tension roller 16.

The tension roller 16 is disposed downstream from the separation aid 15 and upstream from the heating roller 13 in the rotation direction D12 of the fixing belt 12. The tension roller 16 pressing against the inner circumferential surface of the fixing belt 12 exerts a desired tension to the fixing belt 12. The tension roller 16 is rotatable in a rotation direction D16. Alternatively, the tension roller 16 may be disposed outside the loop formed by the fixing belt 12.

A detailed description is now given of a configuration of the separator 17 and the separation claw 18.

As shown in FIG. 3, a slight gap M is provided between a front edge of the separator 17 and an outer circumferential surface of the fixing belt 12 to separate the sheet P from the fixing belt 12 at a position downstream from the fixing nip N in the sheet conveyance direction DP.

An oil applicator applies oil in a desired amount to the fixing belt 12 and the pressure roller 14. The separator 17 and the separation claw 18 disposed downstream from the fixing nip N in the sheet conveyance direction DP or the rotation direction R12 of the fixing belt 12 prevent the sheet P from being wound around the fixing belt 12 and the pressure roller 14, ejecting the sheet P from a downstream section, that is, an exit, of the fixing nip N.

A description is provided of slackening of the fixing belt 12.

In the fixing device 10 incorporating the components described above, as the fixing roller 11 rotates clockwise in FIG. 3 in the rotation direction D11, the fixing belt 12 rotates clockwise in the rotation direction D12. Simultaneously, the pressure roller 14 rotates counterclockwise in FIG. 3 in the rotation direction D14. When the outer circumferential surface of the fixing belt 12 is heated to a given temperature, a sheet P bearing an unfixed toner image is conveyed through the fixing nip N leftward in FIG. 3. At the fixing nip N, the fixing belt 12 heated by the heater 13H through the heating roller 13 and the pressure roller 14 apply heat and pressure to the sheet P, melting and fixing the toner image on the sheet P.

Thereafter, the sheet P bearing the fixed toner image is ejected from the fixing nip N. Since the separation aid 15 disposed downstream from the fixing nip N in the sheet conveyance direction DP decreases the radius of curvature of the fixing belt 12, a leading edge of the sheet P separates from the fixing belt 12 readily. Thus, the sheet P separates from the fixing belt 12. The leading edge of the sheet P is isolated from the fixing belt 12 by at least the slight gap M between the separator 17 and the fixing belt 12.

As the rigid pressure roller 14 is pressed against the fixing roller 11 including the surface elastic layer 11A at the fixing nip N, the elastic layer 11A is elastically deformed, decreasing the outer diameter and an outer circumference of the fixing roller 11. Accordingly, at the position downstream from the fixing nip N, the fixing belt 12 is slackened by an amount of decrease in the outer circumference of the fixing roller 11.

Since the fixing belt 12 is stretched taut across the fixing roller 11 with a given tension, if the friction force between the fixing roller 11 and the fixing belt 12 is decreased to facilitate sliding of the fixing belt 12 over the fixing roller 11, slack of the fixing belt 12 is eliminated. However, if the friction force between the fixing roller 11 and the fixing belt 12 is decreased, even when the fixing roller 11 rotates, motive power may not be transmitted from the fixing roller 11 to the fixing belt 12 readily, degrading rotation of the fixing belt 12.

At the fixing nip N, the elastic layer 11A is elastically deformed, decreasing the outer diameter and the outer circumference of the fixing roller 11. Accordingly, at the position downstream from the fixing nip N in the sheet conveyance direction DP, the fixing belt 12 is slackened by an amount of decrease in the outer circumference of the fixing roller 11. Since the contact face 15A of the separation aid 15 projects from the outer circumferential surface of the fixing roller 11 radially, the fixing belt 12 is slackened in a portion thereof that contacts the contact face 15A and a portion thereof that bridges the fixing roller 11 and the contact face 15A.

A description is provided of a relation between a friction force FO and an inhibition force Fd.

As shown in FIG. 2, the friction force F0, that is, a rotation friction force, generates between the fixing roller 11 and the fixing belt 12 as the fixing roller 11 rotates in the rotation direction D11. The inhibition force Fd is generated by the heating roller 13, the separation aid 15, and the tension roller 16 and exerted in a direction opposite the rotation direction D12 of the fixing belt 12.

The friction force F0 generated between the fixing roller 11 and the fixing belt 12 is determined by a static friction coefficient and a tension of the fixing belt 12 when motive power, that is, a driving force, is transmitted from the fixing roller 11 to the fixing belt 12. Conversely, the friction force FO generated between the fixing roller 11 and the fixing belt 12 is determined by a kinetic friction coefficient and a tension of the fixing belt 12 when motive power is not transmitted from the fixing roller 11 to the fixing belt 12. In the fixing device 10 according to this example embodiment, motive power is transmitted from the fixing roller 11 to the fixing belt 12 and the friction force FO is determined based on a static friction coefficient μ0.

The static friction coefficient μ0 is not smaller than about 0.4, preferably not smaller than about 0.5. If the static friction coefficient μ0 is excessively small, it may be difficult to set the friction force FO to be greater than the inhibition force Fd.

A detailed description is now given of the inhibition force Fd generated as the halted fixing roller 11 starts rotation.

An inhibition force Fd1 generated by the heating roller 13, when the heating roller 13 rotates in the rotation direction D13, is defined as an addition of a rotation force Fr1 to a kinetic friction force Fa1. The rotation force Fr1 is determined by a radius, a whole mass distribution, and an acceleration of the heating roller 13. The kinetic friction force Fa1 generates at a rotation shaft of the heating roller 13. When the heating roller 13 does not rotate, that is, when the fixing belt 12 slides over an outer circumferential surface of the heating roller 13, the inhibition force Fd1 is defined as a kinetic friction force Fs1 generated between the fixing belt 12 and the heating roller 13.

An inhibition force Fd2 generated by the separation aid 15 is defined as a kinetic friction force Fs2 generated between the fixing belt 12 and the contact face 15A of the separation aid 15.

An inhibition force Fd3 generated by the tension roller 16, when the tension roller 16 rotates in the rotation direction D16, is defined as an addition of a rotation force Fr3 to a kinetic friction force Fa3. The rotation force Fr3 is determined by a radius, a whole mass distribution, and an acceleration of the tension roller 16. The kinetic friction force Fa3 generates at a rotation shaft of the tension roller 16. When the tension roller 16 does not rotate, that is, when the fixing belt 12 slides over an outer circumferential surface of the tension roller 16, the inhibition force Fd3 is defined as a kinetic friction force Fs3 generated between the fixing belt 12 and the tension roller 16.

In the fixing device 10 according to this example embodiment, the combined inhibition force Fd, that is, a total inhibition force, is defined as an aggregation of the inhibition forces Fd1 to Fd3. When the fixing roller 11 starts rotation, the friction force FO generated between the fixing roller 11 and the fixing belt 12 is greater than the inhibition force Fd, transmitting motive power from the fixing roller 11 to the fixing belt 12 and therefore preventing sliding or slippage of the fixing belt 12.

A detailed description is now given of an inhibition force Fd' generated as the number of rotations of the fixing roller 11 reaches a given value and the fixing roller 11 rotates at a constant speed.

An inhibition force Fd1' generated by the heating roller 13, when the heating roller 13 rotates in the rotation direction D13, is defined as the kinetic friction force Fa1 that generates at the rotation shaft of the heating roller 13. When the heating roller 13 does not rotate, the inhibition force Fd1' is defined as the kinetic friction force Fs 1 that generates between the fixing belt 12 and the heating roller 13.

An inhibition force Fd2' generated by the separation aid 15 is defined as the kinetic friction force Fs2 generated between the fixing belt 12 and the contact face 15A of the separation aid 15.

An inhibition force Fd3' generated by the tension roller 16, when the tension roller 16 rotates in the rotation direction D16, is defined as the kinetic friction force Fa3 that generates at the rotation shaft of the tension roller 16. When the tension roller 16 does not rotate, the inhibition force Fd3' is defined as the kinetic friction force Fs3 generated between the fixing belt 12 and the tension roller 16.

When the fixing roller 11 rotates at the constant speed, the combined inhibition force Fd', that is, a total inhibition force, is defined as an aggregation of the inhibition forces Fd1' to Fd3' and is smaller than the combined inhibition force Fd that generates when the fixing roller 11 starts rotation. Accordingly, when the fixing roller 11 starts rotation, motive power is transmitted from the fixing roller 11 to the fixing belt 12 and therefore motive power is also transmitted when the fixing roller 11 rotates at the constant speed.

The present disclosure is not limited to the example embodiments described above and various modifications are available as described below.

Figure 4:
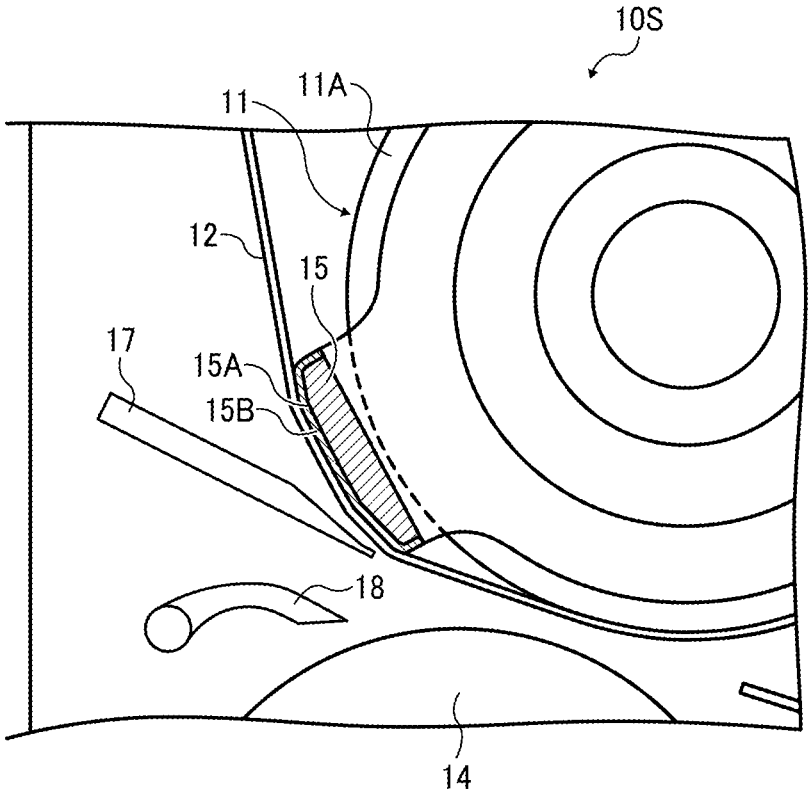
FIG. 4 is a partial vertical sectional view of a fixing device according to a second example embodiment.

For example, according to the example embodiments described above, the contact face 15A of the separation aid 15 is coated with fluoroplastic to produce a smooth surface. Alternatively, as shown in FIG. 4, the contact face 15A of the separation aid 15 may be coated with a smooth sheet 15B. FIG. 4 is a partial vertical sectional view of a fixing device 10S according to a second example embodiment that incorporates the smooth sheet 15B. As shown in FIG. 4, the smooth sheet 15B made of fluoroplastic constitutes a surface of the separation aid 15 that contacts the inner circumferential surface of the fixing belt 12. Alternatively, the contact face 15A of the separation aid 15 may be treated with other surface processing that adjusts the friction force generated between the fixing belt 12 and the separation aid 15 to a desired value.

According to the example embodiments described above, the static friction coefficient between the fixing roller 11 and the fixing belt 12 is not smaller than about 0.5. Alternatively, the static friction coefficient between the fixing roller 11 and the fixing belt 12 may be set to other proper value that causes the friction force F0 to be greater than the inhibition force Fd.

According to the example embodiments described above, the fixing device 10 incorporates the tension roller 16. Alternatively, the tension roller 16 may be removed as long as the fixing belt 12 is exerted with proper tension.

A description is provided of advantages of the fixing devices 10 and 10S.

As shown in FIGS. 2 to 4, the fixing devices 10 and 10S include the fixing roller 11 serving as a first roller including the surface elastic layer 11A; the heating roller 13 serving as a second roller accommodating the heater 13H; the endless fixing belt 12, rotatable in a predetermined direction of rotation (e.g., the rotation direction D12), heated by the heater 13H and stretched taut across the fixing roller 11 and the heating roller 13; the pressure roller 14 serving as a pressure rotator pressed against the fixing roller 11 via the fixing belt 12 to form the fixing nip N between the fixing belt 12 and the pressure roller 14; and the separation aid 15 disposed downstream from the fixing nip N in the direction of rotation of the fixing belt 12 to decrease a curvature of the fixing belt 12. As the fixing roller 11 rotates the fixing belt 12 in the predetermined direction of rotation, a rotation friction force (e.g., the friction force F0) generated between the fixing roller 11 and the fixing belt 12 to rotate the fixing belt 12 is greater than an inhibition force exerted in a direction opposite the direction of rotation of the fixing belt 12.

Since the separation aid 15 is situated downstream from the fixing nip N in the direction of rotation of the fixing belt 12, if the fixing roller 11 is elastically deformed at the fixing nip N, the fixing belt 12 may be slackened at a position in proximity to the separation aid 15. To address this circumstance, the kinetic friction coefficient between the separation aid 15 and the fixing belt 12 is adjusted to cause sliding or slippage of the fixing belt 12, eliminating slack of the fixing belt 12 by tension exerted to the fixing belt 12. It is not necessary to decrease the friction force between the fixing roller 11 and the fixing belt 12 to eliminate slack of the fixing belt 12. The friction force is increased relative to the inhibition force to facilitate precise rotation of the fixing belt 12.

The fixing belt 12 is slackened on the smooth contact face 15A of the separation aid 15. Accordingly, slack of the fixing belt 12 is eliminated by tension of the fixing belt 12, decreasing the inhibition force Fd. The friction force FO generated between the fixing roller 11 and the fixing belt 12 is greater than the inhibition force Fd, facilitating precise rotation of the fixing belt 12.

The separation aid 15 situated downstream from the fixing nip N in the rotation direction D12 of the fixing belt 12 decreases the curvature of the fixing belt 12, facilitating separation of the sheet P from the fixing belt 12.

The contact face 15A coated with fluoroplastic decreases the kinetic friction coefficient, eliminating slack of the fixing belt 12 readily and decreasing the inhibition force Fd further, which result in precise rotation of the fixing belt 12.

The tension roller 16 places tension to the fixing belt 12, facilitating elimination of slack of the fixing belt 12. Further, the tension roller 16 increases the friction force F0 generated between the fixing roller 11 and the fixing belt 12, rotating the fixing belt 12 precisely.

According to the example embodiments described above, the fixing device 10 is installed in a tandem color copier serving as the image forming apparatus 200 as shown in FIG. 1. Alternatively, the fixing devices 10 and 10S may be installed in other image forming apparatuses, such as a copier, a facsimile machine, a printer, and a multifunction peripheral or a multifunction printer (MFP), that employ various methods.

According to the example embodiments described above, the fixing belt 12 serves as an endless fixing belt. Alternatively, a fixing film, a fixing sleeve, or the like may be used as an endless fixing belt. Further, the pressure roller 14 serves as a pressure rotator. Alternatively, a pressure belt or the like may be used as a pressure rotator.

The present disclosure has been described above with reference to specific example embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative example embodiments may be combined with each other and/or substituted for each other within the scope of the present disclosure.

What is claimed is:

1. A fixing device comprising:

an endless fixing belt rotatable in a set direction of rotation;

a first roller contacting the fixing belt and including a surface elastic layer to generate a rotation friction force between the fixing belt and the first roller to rotate the fixing belt;

a second roller contacting the fixing belt to exert a first inhibition force to the fixing belt in a direction opposite the direction of rotation of the fixing belt, the fixing belt stretched taut across the first roller and the second roller;

a pressure rotator pressed against the first roller via the fixing belt to form a fixing nip between the fixing belt and the pressure rotator, through which a recording medium is conveyed; and a separation aid disposed downstream from the fixing nip in the direction of rotation of the fixing belt to decrease a curvature of the fixing belt and exert a second inhibition force to the fixing belt in the direction opposite the direction of rotation of the fixing belt, the second inhibition force being added to the first inhibition force to obtain a combined inhibition force that is smaller than the rotation friction force between the fixing belt and the first roller, wherein the separation aid projects from an outer circumferential surface of the first roller radially.

2. The fixing device according to claim 1, wherein the separation aid includes a smooth contact face contacting an inner circumferential surface of the fixing belt.

3. The fixing device according to claim 2, wherein the contact face of the separation aid is made of fluoroplastic.

4. The fixing device according to claim 2, further comprising a smooth sheet coating the contact face of the separation aid and having a fluoroplastic surface that contacts the inner circumferential surface of the fixing belt.

5. The fixing device according to claim 1, wherein the first inhibition force includes a first friction force between the second roller and the fixing belt and the second inhibition force includes a second friction force between the separation aid and the fixing belt.

6. The fixing device according to claim 1, wherein a static friction coefficient between the first roller and the fixing belt is not smaller than about 0.5.

7. The fixing device according to claim 1, further comprising a tension roller contacting the fixing belt to exert tension to the fixing belt.

8. The fixing device according to claim 7, wherein the tension roller presses against an inner circumferential surface of the fixing belt.

9. The fixing device according to claim 7, wherein the tension roller exerts a third inhibition force to the fixing belt in the direction opposite the direction of rotation of the fixing belt.

10. The fixing device according to claim 9, wherein the third inhibition force includes a third friction force between the tension roller and the fixing belt.

11. The fixing device according to claim 1, further comprising a heater disposed inside the second roller to heat the fixing belt through the second roller.

12. The fixing device according to claim 1, further comprising a separator disposed downstream from the fixing nip in the direction of rotation of the fixing belt to separate the recording medium from the fixing belt.

13. The fixing device according to claim 1, wherein the pressure rotator includes a pressure roller.

14. The fixing device according to claim 1, wherein the separation aid is integrally formed with the first roller.

15. The fixing device according to claim 1, further comprising a separator downstream from the fixing nip in the sheet conveyance direction.

16. The fixing device according to claim 15, wherein a gap is provided between a front edge of the separator and an outer circumferential surface of the fixing belt.

17. The fixing device according to claim 1, further comprising a separation claw downstream from the fixing nip in the sheet conveyance direction.

18. An image forming apparatus comprising:

an image forming device to form a toner image; and a fixing device, disposed downstream from the image forming device in a recording medium conveyance direction, to fix the toner image on a recording medium, the fixing device including:

an endless fixing belt rotatable in a set direction of rotation;

a first roller contacting the fixing belt and including a surface elastic layer to generate a rotation friction force between the fixing belt and the first roller to rotate the fixing belt;

a second roller contacting the fixing belt to exert a first inhibition force to the fixing belt in a direction opposite the direction of rotation of the fixing belt, the fixing belt stretched taut across the first roller and the second roller;

a pressure rotator pressed against the first roller via the fixing belt to form a fixing nip between the fixing belt and the pressure rotator, through which the recording medium is conveyed; and a separation aid disposed downstream from the fixing nip in the direction of rotation of the fixing belt to decrease a curvature of the fixing belt and exert a second inhibition force to the fixing belt in the direction opposite the direction of rotation of the fixing belt, the second inhibition force being added to the first inhibition force to obtain a combined inhibition force that is smaller than the rotation friction force between the fixing belt and the first roller, wherein the separation aid projects from an outer circumferential surface of the first roller radially.

19. A fixing device comprising:

an endless fixing belt rotatable in a set direction of rotation;

a first roller contacting the fixing belt and including a surface elastic layer to generate a rotation friction force between the fixing belt and the first roller to rotate the fixing belt;

a second roller contacting the fixing belt to exert a first inhibition force to the fixing belt in a direction opposite the direction of rotation of the fixing belt, the fixing belt stretched taut across the first roller and the second roller;

a pressure rotator pressed against the first roller via the fixing belt to form a fixing nip between the fixing belt and the pressure rotator, through which a recording medium is conveyed; and a separation aid disposed downstream from the fixing nip in the direction of rotation of the fixing belt to decrease a curvature of the fixing belt and exert a second inhibition force to the fixing belt in the direction opposite the direction of rotation of the fixing belt, the second inhibition force being added to the first inhibition force to obtain a combined inhibition force that is smaller than the rotation friction force between the fixing belt and the first roller, wherein the separation aid is spaced apart from the pressure rotator.

* * * * *